US008302626B2

(12) United States Patent
Dabi

(10) Patent No.: US 8,302,626 B2
(45) Date of Patent: Nov. 6, 2012

(54) PLANT FOR RECOVERING A POLLUTING FLUID CONTAINED IN THE TANKS OF A SUNKEN VESSEL

(75) Inventor: Jean-Luc Dabi, Seneffe (BE)

(73) Assignee: JLMD Ecologic Group (FR)

( * ) Notice: Subject to any disclaimer, the term of this patent is extended or adjusted under 35 U.S.C. 154(b) by 187 days.

(21) Appl. No.: 11/720,100

(22) PCT Filed: Nov. 7, 2005

(86) PCT No.: PCT/FR2005/002765

§ 371 (c)(1),
(2), (4) Date: May 24, 2007

(87) PCT Pub. No.: WO2006/056671

PCT Pub. Date: Jun. 1, 2006

(65) Prior Publication Data

US 2009/0120861 A1 May 14, 2009

(30) Foreign Application Priority Data

Nov. 25, 2004 (FR) ..... 04 12502

(51) Int. Cl.
*F17D 1/12* (2006.01)
*F16K 24/00* (2006.01)

(52) U.S. Cl. ..... 137/592; 137/563; 137/68.19; 405/52

(58) Field of Classification Search ..... 137/563, 137/68.19, 583, 590, 592; 405/52
See application file for complete search history.

(56) References Cited

U.S. PATENT DOCUMENTS 4,195,653 A * 4/1980 Cessou ..... 137/206
4,404,982 A * 9/1983 Ou ..... 137/68.25
5,795,103 A * 8/1998 Gaerlan ..... 405/188
6,959,828 B2 * 11/2005 Eijkelenberg et al. ..... 220/89.2

FOREIGN PATENT DOCUMENTS

WO 94/08841 4/1994
WO WO 2004065205 A1 * 8/2004

OTHER PUBLICATIONS

International Search Report; PCT/FR2005/002765; Mar. 3, 2006.

* cited by examiner

*Primary Examiner* — Craig Schneider
*Assistant Examiner* — Atif Chaudry
(74) *Attorney, Agent, or Firm* — Cantor Colburn LLP

(57) ABSTRACT

The invention relates to a plant for recovering a polluting fluid contained in the tank (4) of a sunken vessel (1) comprising a plurality of pipes (5) fixed to a deck (2), wherein each pipe comprises a first and second ends and, according to the beaching position of the sunken vessel, can form means for introducing a pressurized water into the tank or means for removing the polluting fluid outside thereof. Said invention is characterized in that said pipes are positioned in such a way that the ends thereof enters near each top corner of the tank and the second ends thereof are accessible from the inside of the sunken vessel.

16 Claims, 6 Drawing Sheets

PLANT FOR RECOVERING A POLLUTING FLUID CONTAINED IN THE TANKS OF A SUNKEN VESSEL

TECHNICAL FIELD OF THE INVENTION

The present invention relates, on the one hand, to a plant for recovering a polluting fluid contained in the tanks of a sunken vessel and, on the other hand, to a specific conduit used for such a plant.

BRIEF DISCUSSION OF RELATED ART

Following the recent wrecks of vessels carrying polluting fluids, patent application WO 02/057131, filed in the name of Environment Technological Group and designating Mr. DABI as the inventor, has proposed a simple and reliable system for recovering the polluting fluid contained in the tanks of a wrecked ship.

This recovery system comprises a compartment in each of the tanks of the ship that has gone down, this compartment containing several flow lines and a float element capable of being ejected from the sunken vessel. More specifically, for each compartment, this system comprises a line for discharging the polluting fluid comprising a first end connected to the tank and a second end connected to the float element. This second end can be pulled out far enough away from the sunken vessel using a cable to which the float element is attached. For each compartment, this system also has a suction line and an injection line both connected to the discharge line and equipped with a respective first end that floats on the surface of the polluting fluid contained in the tank and a weighted first end positioned in the bottom of said tank. Finally, for each compartment, this system comprises a connecting line extending from a salvage vessel on the surface and comprising, on the one hand, a first end push-fitted into the second end of the discharge line and, on the other hand, a second end connected to a pump installed on the salvage vessel. In operation, pressurized water is injected from the salvage vessel into the bottom of the tank via the injection line. The polluting fluid is then delivered to the salvage vessel via the suction line, the discharge line and the connecting line.

This recovery system does nevertheless have a disadvantage in that, when the vessel has sunk, it is not easy to gain access from outside to the compartments housed within the tanks. Another disadvantage lies in the fact that, although it is possible to envision installing such compartments in the tanks while the vessel is being built, it is, by contrast, very tricky to perform such an operation on an existing vessel. Furthermore, since the compartments are stored inside the tanks, problems of sealing and safety may arise. In addition, this system has, of necessity, to involve on the one hand, pulling the second end of the discharge line out of the tank and, on the other hand, leading the second end of the injection line up to the surface, it then follows that the connection between the connecting line and the discharge line is relatively complicated to achieve. Finally, there is no need to weight the second end of the injection line because the density of the water introduced under pressure is greater than the density of the polluting fluid.

Patent application FR 03.00044 has therefore proposed a plant comprising means for introducing water under pressure into the run of tanks and means for discharging the polluting fluid to outside the run of tanks, at least one connecting line from a salvage vessel being able to be connected to one of the discharge means, characterized in that it comprises a plurality of fixed lines, each having a first end and a second end, these fixed lines being positioned in such a way that their first ends open at least at each of the corners of the ends of the run of tanks and such that their second ends are each attached to a valve which, on the one hand, is housed in a compartment fixed above the waterline of the sunken vessel and, on the other hand, can be operated from outside the sunken vessel, each of said fixed lines being able, depending on the position in which the sunken vessel has gone down, to form a means of introducing pressurized water into the run or a means of discharging the polluting fluid from said run.

Specifically, since each of the compartments containing valves lies above the waterline of the sunken vessel, an ROV (underwater remote operated vehicle) or a diver can far more easily gain access to these compartments and thus carry out the connection and operation tasks. In addition, as these compartments are preferably fixed to the deck of the vessel, installing them on an existing vessel is relative easy and any problems of sealing and safety that there might be are resolved. Furthermore, given, on the one hand, that the end of a fixed line opens into each corner of the ends of the transverse run of tanks and, on the other hand, that each fixed line is connected to a valve at its second end, there is no longer a need to envision bringing one of the ends of the injection line up to the surface so that pressurized water can be introduced from the salvage vessel. Indeed, the ROV or the diver directly as required opens one or more valves housed in these compartments accessible from outside the vessel. The fixed line or lines associated with this or these valves therefore act as inlet lines, seawater at hydrostatic pressure rushing in through said valves then running along each of these fixed lines and finally being introduced into the transverse run of tanks. As seawater has a greater density than the polluting fluid, it then follows that the contaminating fluid is displaced by the seawater toward the uppermost point of the transverse run of tanks. This polluting fluid is then made to enter at least one other fixed line, acting as a discharge line, the first end of which lies in the uppermost end corner of the transverse run of tanks. This polluting fluid is then discharged along this fixed line toward the associated compartment, then discharged along the connecting line, to which the second end of the fixed discharge line is connected, toward the surface where the salvage vessel is situated, and can finally be transferred from the connecting line into the tanks of the salvage vessel using a pump mounted on the latter.

Nonetheless, even though such a plant perfectly complies with the stated objectives, a first disadvantage lies in the fact that the fixed lines make it difficult to clean out the tanks. Specifically, a tank is generally cleaned out using a motorized device, positioned at the center of the tank, and spraying a liquid against the walls that form the tank. In this case, the fixed lines then form screens that mask certain areas of the tank. In addition, cleaning out the inside of the fixed lines is itself relatively difficult to achieve. This problem is particularly keenly felt in the case of vessels that carry polluting chemical products in respect of which a risk of contamination is therefore not something that can be overlooked.

Furthermore, the incorporation of suitable metal lines means that numerous shaping operations are needed, these operations having repercussions in terms of cost. In addition, systematically from the outset incorporating compartments comprising valve closure/opening systems is both expensive and difficult to perform. More generally, a plant of this type has a relatively high overall cost inasmuch as, given that it allows the polluting fluid to be recovered irrespective of the position in which the vessel has gone down, the total number of lines and of associated compartments that need to be envisioned is high. Now, it would be desirable to be able to propose a simplified plant which would nonetheless provide a solution for most downed-vessel scenarios, but has a lower overall cost.

BRIEF SUMMARY OF THE INVENTION

The invention seeks to remedy the disadvantages mentioned earlier, and for that purpose the present invention consists of a plant for recovering a polluting fluid contained in at least one tank of a sunken vessel, this plant comprising a plurality of conduits fixed into the deck of the vessel, each conduit having a first end and a second end and being able, depending on the position in which the sunken vessel has gone down, to constitute a means for introducing pressurized water into the tank or means for discharging the polluting fluid to outside the tank, characterized in that these conduits are positioned in such a way that, on the one hand, their first ends open near each of the top corners of the tank and, on the other hand, their second ends are directly accessible from outside the sunken vessel.

A plant such as this is particularly advantageous inasmuch as the elements to be incorporated into the vessel at the outset are low in number and consist of simple short conduits.

Specifically, depending on the position in which the vessel has gone down, all that will then be required will be for a long tubular needle to be slipped, from the deck of the ship, through an appropriate conduit, using special tooling in order, as appropriate, to access either the top or the bottom of the tank.

If the vessel has more or less gone down on its keel, this tubular needle will be able, once a set of valves housed in said tubular needle and in the special tooling has been opened/closed, to convey pressurized water into the lowermost point of the tank. At least one of the other conduits will then allow recovery of the polluting fluid and for that purpose will be connected, also using special tooling provided with an appropriate set of valves, to a recovery line connected to a salvage vessel.

If the vessel has gone down more or less on its deck, this tubular needle will serve to recover the polluting fluid and for that will be connected, using special tooling provided with an appropriate set of valves, to a recovery line connected to a salvage vessel. In such a configuration, at least one of the other conduits will allow pressurized water to be introduced into the lowermost part of the tank using special tooling provided with an appropriate set of valves.

Quite obviously, depending on the configuration in which the vessel has gone down, it may be advantageous to introduce several long tubular needles and/or to connect several recovery lines.

As a result, a plant such as this is notable in that it no longer comprises any long element permanently fixed inside the tank.

In addition, it is also possible to avoid dependency on the compartments which were hitherto positioned above the waterline of the vessel, by incorporating the function that they had into the special tooling connected to the plant only in the event that the vessel is wrecked.

Finally, although it is true that such a plant may fail to work when the vessel is resting on its deck and the conduits are inaccessible, and it is relatively rare for a vessel to go down in this position, it nonetheless remains the case that all other positions in which a vessel might go down can be dealt with, and that this can be done using just four short conduits positioned one near each of the top corners of the tank.

Advantageously, each conduit is surmounted by a flange accessible from the deck of the vessel. This flange thus allows easier connection with the special tooling which is attached in the event that the vessel is wrecked.

Advantageously too, the flange is blanked off by at least one rupture disk. If the vessel is wrecked, the attached special tooling is equipped with a rupturing member able to rupture the rupture disk(s). As a preference, each rupture disk comprises a substantially circular line of weakness.

Also as a preference, the rupture disk is covered by at least one removable protective plate, it being possible for each of these to be bolted to the rupture disk.

As a preference, each conduit is substantially tubular.

BRIEF DESCRIPTION OF THE DRAWINGS

The invention will be better understood with the aid of the detailed description which is explained hereinbelow with reference to the attached drawing in which:

FIG. 1 is a schematic view from above of a vessel 1 having a deck 2 covering five runs 3 of tanks 4 which are transverse and parallelepipedal containing a polluting fluid 30.

DETAILED DESCRIPTION OF THE INVENTION

Figure 4:
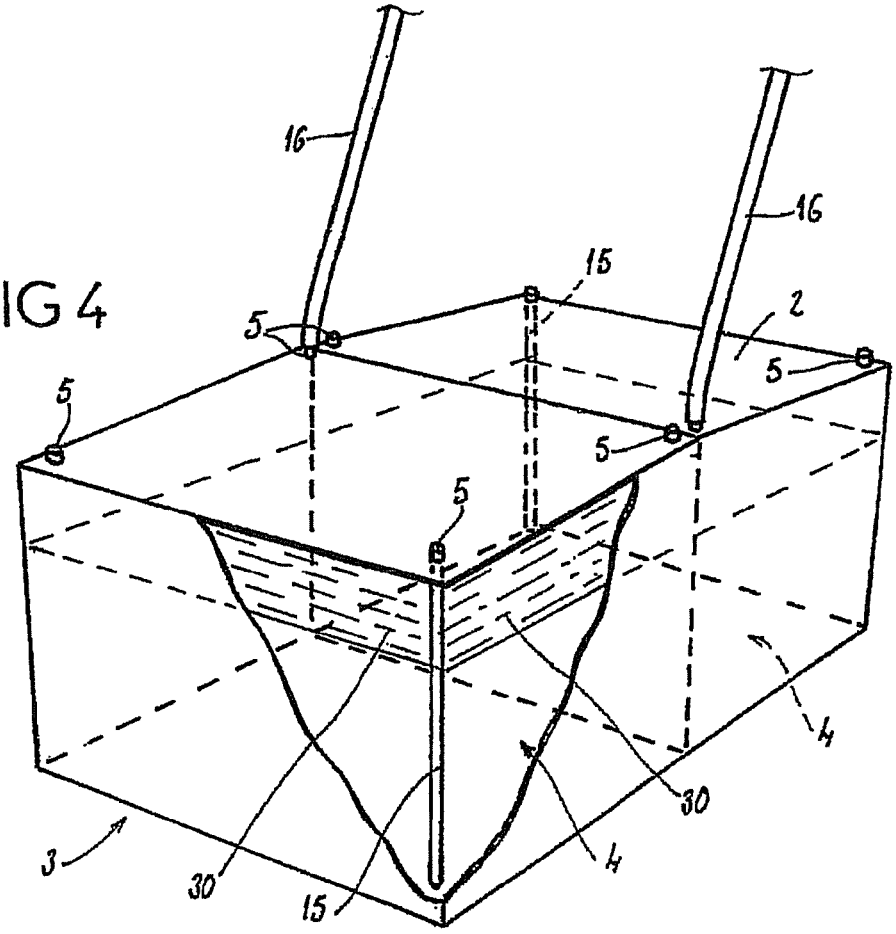
FIG. 4 is a schematic perspective view of two tanks of a vessel that has gone down on its keel, during the phase of recovering the polluting fluid.
Figure 5:
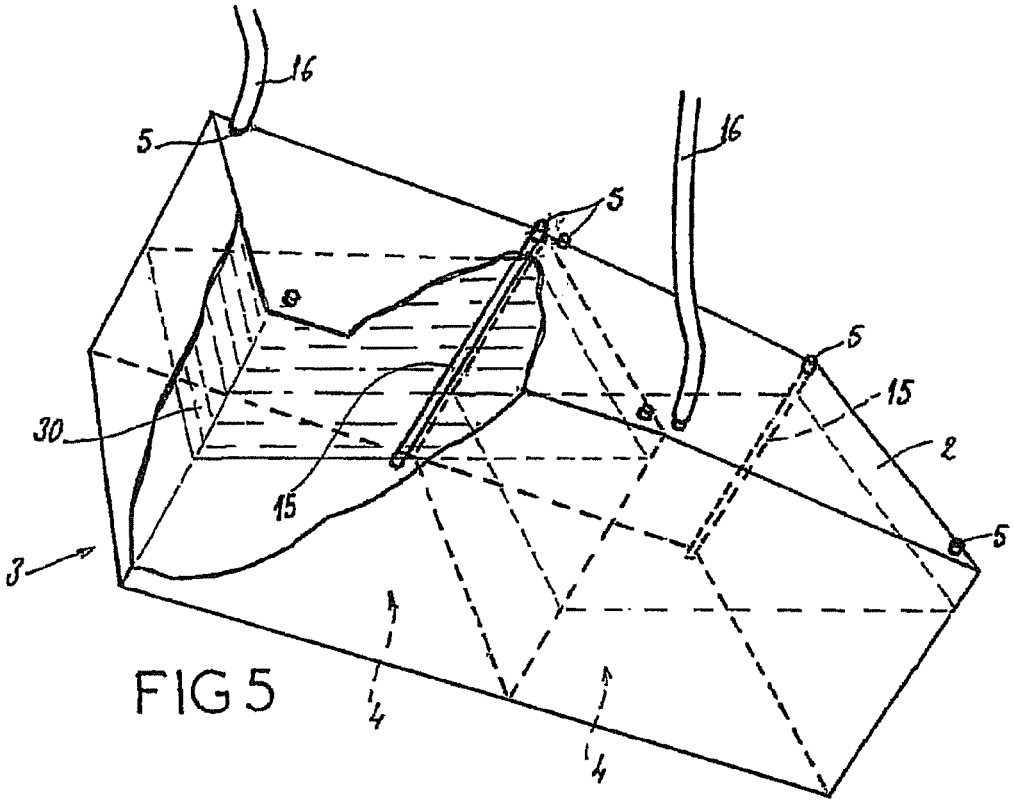
FIG. 5 is a schematic perspective view of two tanks of a vessel that has gone down on its side, during the phase of recovering the polluting fluid.
Figure 6:
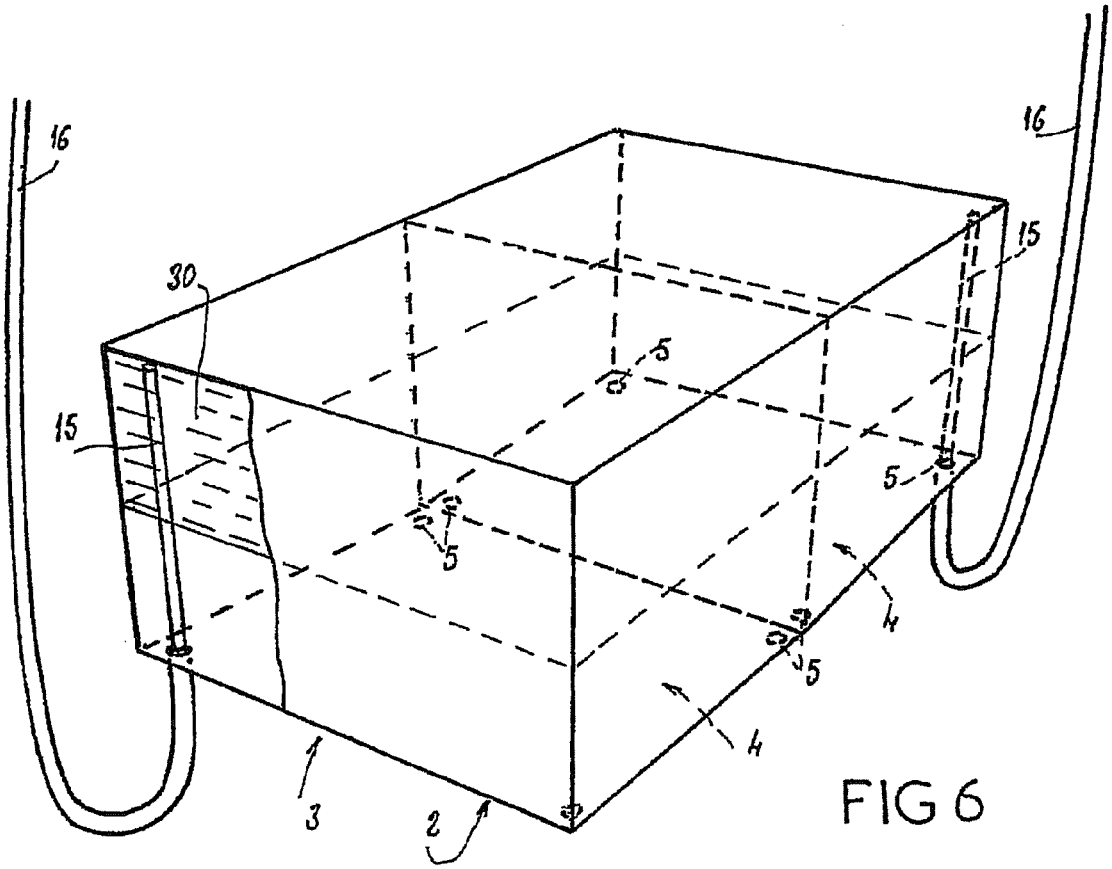
FIG. 6 is a schematic perspective view of two tanks of a vessel that has gone down on its deck, during the phase of recovering the polluting fluid.

As depicted more specifically in FIGS. 4 to 6, each tank 4 comprises four short conduits 5 passing through the deck 2 and each having a first end opening at one of the four top corners of said tank 4.

Figure 1:
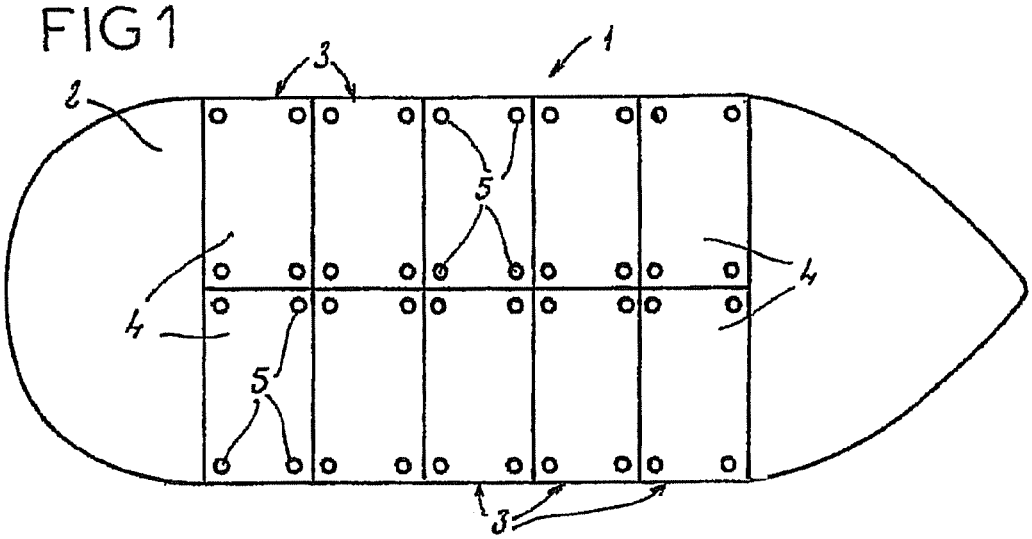
FIG. 1 is a schematic view from above of a vessel comprising several transverse runs of tanks, and equipped with a plant according to the invention.
Figure 2:
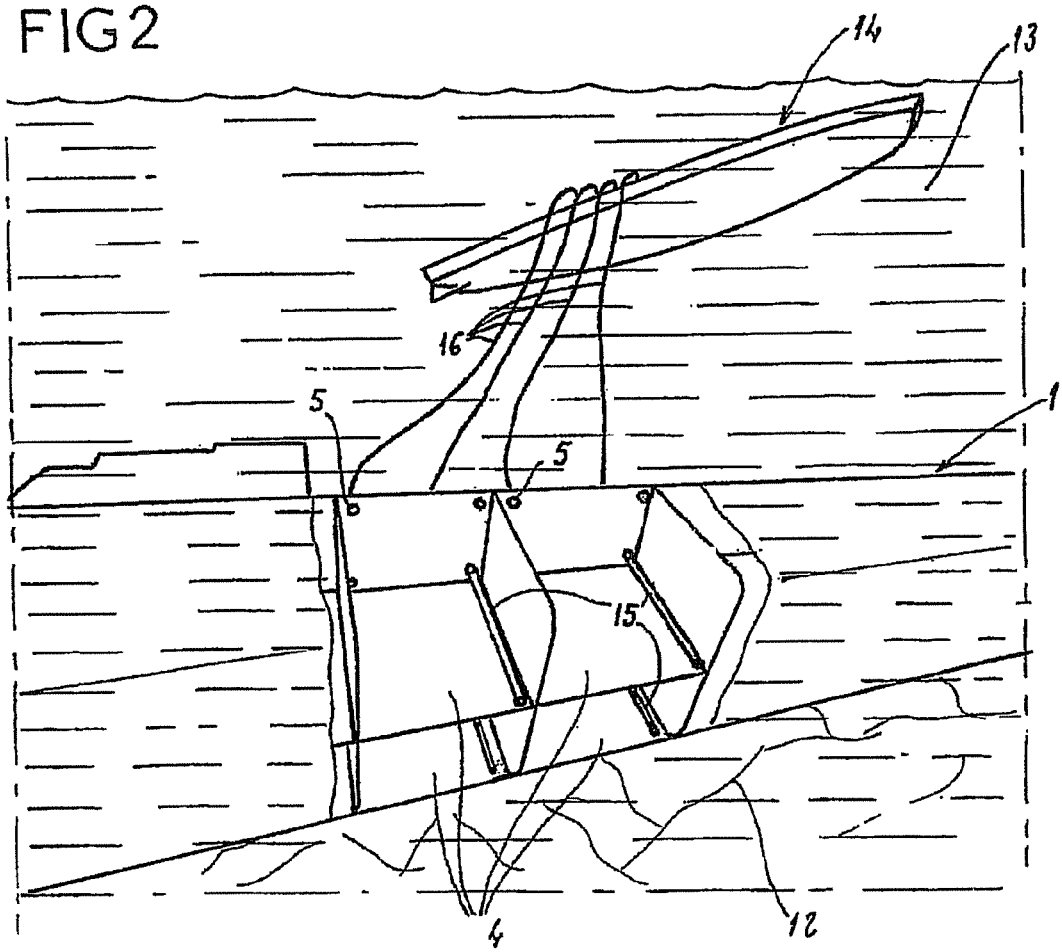
FIG. 2 is a schematic perspective view of the vessel depicted in FIG. 1 in a position in which it has gone down on its side, with part of the keel omitted.
Figure 3:
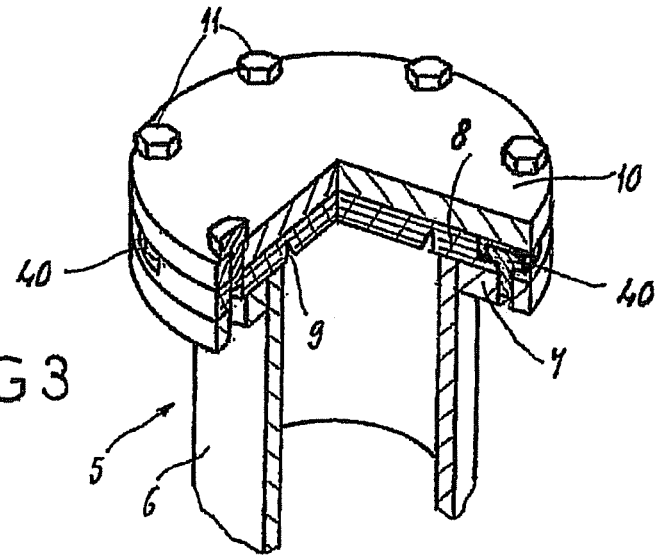
FIG. 3 is a truncated perspective view of a conduit with which the vessel is equipped.

More specifically, as depicted in FIG. 3, each conduit 5 comprises a substantially tubular portion 6 ending at the top in the form of a flange 7 blanked off in succession by a rupture disk 8 comprising a circular line of weakness 9 then by a protective plate 10. The rupture disk 8 is for example secured to the flange 7 using bolts 40 positioned all around the periphery thereof and the protective plate 10 is for example fixed to the rupture disk 8 using bolts 11 positioned all around the periphery thereof, the bolts 40 being angularly offset by about 30° from the bolts 11. The assembly formed by the flange 7, the rupture disk 8 and the protective plate 10 therefore forms a second end that is accessible from outside the vessel 1.

According to a preferred embodiment, provision may be made for the bolts 40 each to have a shank that protrudes from the flange 7 so that a nut (not depicted) can be attached to its end. A configuration such as this then allows the subassembly formed by the rupture disk 8 and the protective plate 10 to be detached from the flange 7 simply by unscrewing said nuts.

When the vessel 1 has sunk and is resting on the bottom 12 of the sea 13, a salvage vessel 14 can station itself substantially vertically above the vessel 1 having located the position of the latter.

As depicted schematically in FIG. 4, from which it is possible to deduce that the vessel 1 has gone down on its keel and that the bottom 12 of the sea is substantially horizontal, a long tubular needle 15 is introduced through one of the conduits 5 of each tank 4 so as to reach the lowermost point thereof. Furthermore, a recovery line 16 connected to the salvage vessel 14 is connected to another conduit 5 in such a way as to communicate with the uppermost part of this tank 4. It must be clearly understood that several tubular needles 15 and/or several recovery lines 16 may be used on the same tank 4.

Figure 7:
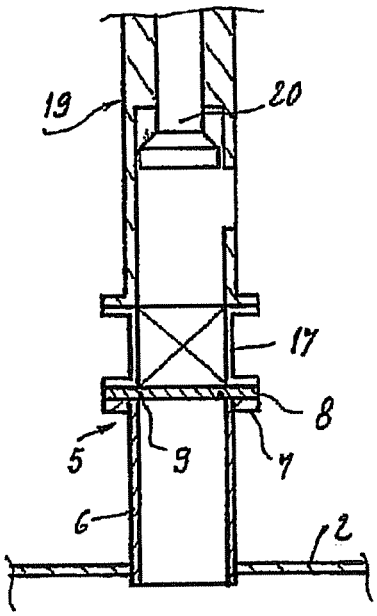
FIGS. 7 to 9 are schematic sectioned views of a conduit to which a special tooling is attached to open the connection point and introduce pressurized water into the tank.
Figure 8:
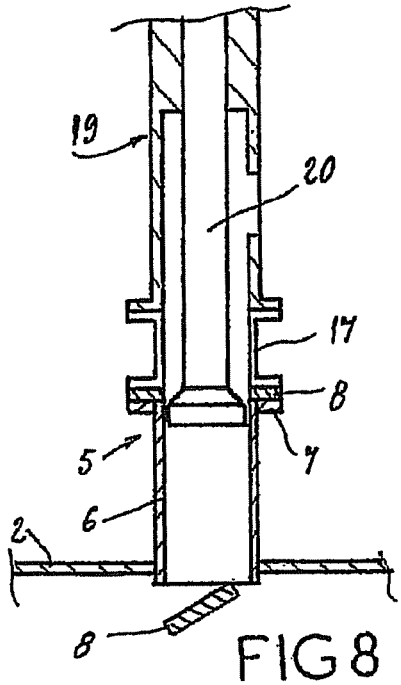
Figure 9:
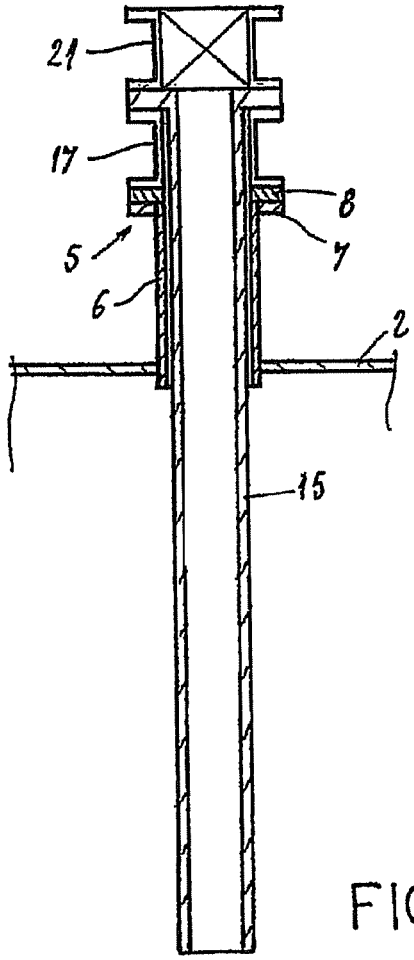

More specifically, and as depicted in FIGS. 7 to 9, the tubular needle 15 may be inserted into the associated conduit 5 as follows. First of all, a diver or an underwater robot removes the protective plate 10. Next, an underwater robot connects an open first valve 17 to the flange 7 using a first set of clamping jaws (not depicted). Special tooling 19 is then fixed in the first valve 17 by the underwater robot using a second set of clamping jaws (not depicted). This special tooling 19 comprises a motorized rupturing member 20 which is initially in the retreated position, as depicted in FIG. 7. As depicted in FIG. 8, this rupturing member 20 is then actuated to cause the rupture disk 8 to be ruptured along its line of weakness 9 once it has passed through the open first valve 17. The rupturing member 20 is then raised back up into the retreated position then the first valve 17 closed. The conduit 15 is therefore once again sealed, and it is possible for the special tooling 19 to be disconnected without causing pressurized water to immediately enter the tank 4.

As depicted in FIG. 9, the end of the tubular needle 15 can then be inserted into the conduit 5, full introduction of the tubular needle 15 into the tank 4 being made possible once the first valve 17 has been opened. This tubular needle 15 is itself equipped with a second valve 21 which is initially closed. As a result, the pressurized water cannot enter the tank 4 during the step of inserting the tubular needle 15 into the tank 4.

Figure 10:
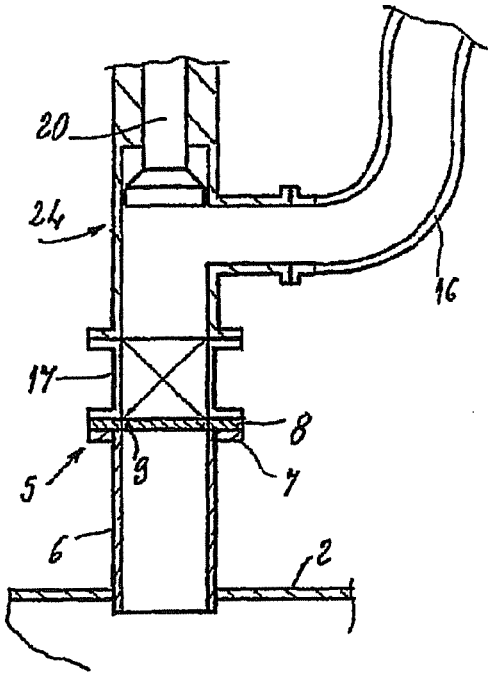
FIGS. 10 to 12 are schematic sectioned views of a conduit to which a special tool is attached to open the connection point and recover the polluting fluid.
Figure 11:
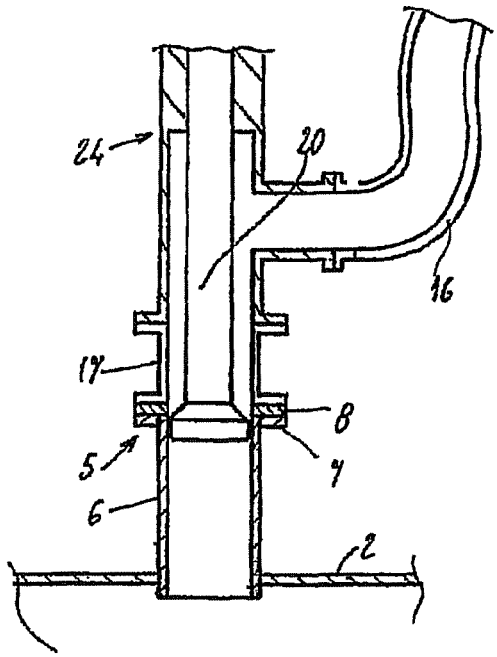

Once the tubular needle 15 has been correctly introduced in such a way that it reaches the lowermost point of the tank 4, the recovery line 16 is then connected to the associated conduit 5 as depicted in FIGS. 10 and 11.

To do that, as before, a diver or an underwater robot first of all removes the protective plate 10. Next, an underwater robot connects an open first valve 17 to the flange 7 via a first set of clamping jaws (not depicted). Special tooling 24 is then fixed into the first valve 17 by the underwater robot using a second set of clamping jaws (not depicted). This special tooling 24 is connected directly to the recovery line 16 and comprises a motorized rupturing member 20 which is initially in the retreated position as depicted in FIG. 10. As depicted in FIG. 11, this rupturing member 20 is then actuated so as to rupture the rupture disk 8 along its line of weakness 9 having passed through the open first valve 17. The rupturing member 20 is then raised back up into the retreated position.

All that is then required is for the second valve 21 of the tubular needle 15 to be opened so as to cause pressurized water to enter the lowermost part of the tank 4, and this has the effect of forcing the polluting fluid 30 to rise up along the recovery line 16.

As a variant, a decision could be taken to connect the recovery line 16 to the special tooling 24 only after the rupturing member 20 has ruptured the rupture disk 8 and return to its retreated position.

In the scenario depicted schematically in FIG. 5, the vessel 1 has gone down on one of its two sides. In order to recover the maximum amount of polluting fluid 30 in the minimum amount of time, it is then highly advantageous to connect the recovery line or lines 16 to the conduit or conduits 5 that lie at the uppermost points of the tank 4.

As depicted schematically in FIG. 6, from which it is possible to deduce that the vessel 1 has more or less gone down on its deck 2 and that the bottom 12 of the sea is substantially horizontal, a long tubular needle 15 is introduced into one of the conduits 5 of each tank 4 in such a way as to reach the uppermost point thereof. Furthermore, a recovery line 16 connected to the salvage vessel 14 is connected to this tubular needle 15. It must be clearly understood that several sets of hollow needles 15/recovery lines 16 may be used for the same tank 4.

As before, the tubular needle 15 may be inserted into the associated conduit 5 as follows. First of all, a diver or an underwater robot removes the protective plate 10. Next, an underwater robot connects an open first valve 17 to the flange 7 via a first set of clamping jaws (not depicted). Special tooling 19 is then connected by the underwater robot to the first valve 17 using a second set of clamping jaws (not depicted). This special tooling 19 comprises a motorized rupturing member 20 initially in the retreated position. This rupturing member 20 is then actuated to rupture the rupture disk 8 along its line of weakness 9 having passed through the open first valve 17. The rupturing member 20 is then raised back up into the retreated position then the first valve 17 is closed. The conduit 5 is thus sealed once again and it is possible to disconnect the special tooling 19 without causing pressurized water to be introduced immediately into the tank 4.

The end of the tubular needle 15 can then be inserted into the conduit 5, it being possible for the tubular needle 15 to be fully introduced into the tank 4 once the first valve 17 has been opened. This tubular needle 15 is itself equipped with a second valve 21 which is initially closed. As a result, the pressurized water cannot enter the tank 4 during the step of inserting the hollow needle 15 into the tank 4.

Figure 12:
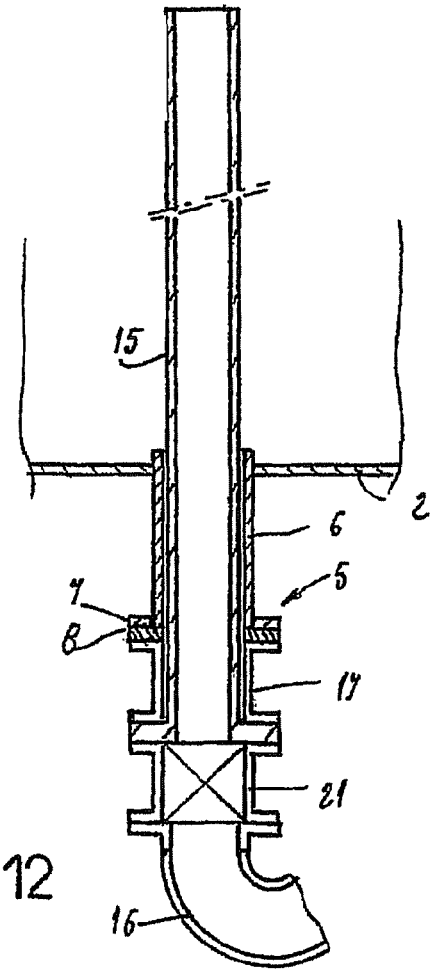

The associated recovery line 16 can then be connected to the tubular needle 15, as depicted schematically in FIG. 12. An embodiment variant may consist in the use of a tubular needle 15 connected to its associated recovery line 16 even before said hollow needle 15 is inserted through the corresponding conduit 5.

In parallel with that, special tooling 19 is fixed to at least one of the other conduits 5 of the tank 4. This special tooling 19 then has the task of rupturing the rupture disk 8. As described previously, the presence of a first valve 17 attached to the conduit 5 ultimately means that pressurized water is not allowed to enter the tank 4 until the desired moment. When this valve 17 is opened, the water rushes into the tank 4 and the polluting fluid 30 is extracted from this tank via the tubular needle 15 then the associated recovery line 16.

Figure 13:
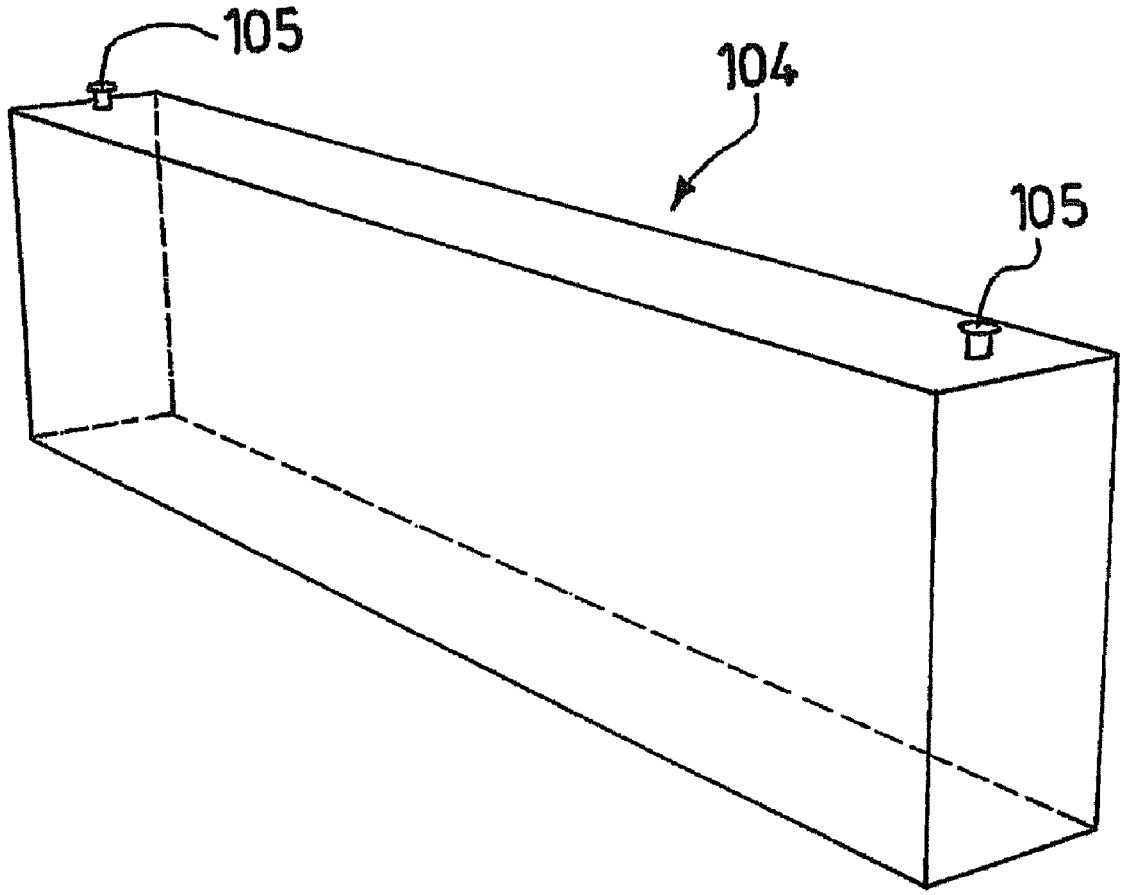
FIG. 13 is a schematic perspective view of a tank of another type used in a variant embodiment of the invention.

A tank 104 of another type is depicted in FIG. 13. This is a parallelepipedal tank on a rectangular base which can be found on all kinds of merchant shipping, for example on oil tankers, bulk carriers, container ships, car ferries, etc. This type of tank 104 is generally used for propulsion fuels and on settling tanks. The length of the long side of the rectangle may vary between 10 and 40 meters approximately and the length of the short side of the rectangle is always shorter than 5 meters, which does not provide enough separation to fit two conduits in the two corners of each short side. It is, however, possible, in such a configuration, to install just two central conduits 105 rather than the four initially intended to be fitted to the four corners of the tank 104.

Although the invention has been described in conjunction with some particular embodiments, it is quite obvious that it is not in any way restricted thereto and that it encompasses all technical equivalents of the means described and combinations thereof where these fall within the scope of the invention.

The invention claimed is:

1. A plant for liquid pollution collection in a marine environment, the plant comprising:

a marine vessel configured and designed to sail on a water surface under normal conditions, the marine vessel having a deck on an upper side of the marine vessel;

a parallelepiped tank disposed at an interior of the marine vessel, the deck delimiting an upper surface of the tank;

a polluting fluid disposed at an interior of the tank; and a conduit disposed in each of four corners of the upper surface of the tank, the conduits extending through the deck to the interior of the tank;

wherein the conduits are all of substantially identical length;

wherein each conduit includes a first end disposed at the interior of the tank, the first end having an opening disposed proximal to the upper surface and distal to a lower surface of the tank disposed opposite from the upper surface;

wherein each conduit further includes a second end having an opening at an exterior of the marine vessel;

wherein the first ends of the conduits are in constant fluid communication;

wherein each conduit is configured to both introduce pressurized water to the interior of the tank and to discharge the polluting fluid to the exterior of the tank; and wherein the interior of the tank comprises an uninterrupted parallelepiped volume;

the plant further comprising at least one long tubular needle configured to be introduced into said tank through one of said conduits in order to reach an uppermost or a lowermost point of said tank, depending respectively on whether the marine vessel is disposed upside down on a deck of the vessel or on a keel of the vessel, and the long tubular needle is further configured for extracting said polluting fluid from said tank and for conveying pressurized water into said tank.

2. The plant as claimed in claim 1, wherein each conduit is surmounted by a flange accessible from the deck of the marine vessel.

3. The plant as claimed in claim 2, wherein the flange is blanked off by a rupture disk.

4. The plant as claimed in claim 3, wherein the rupture disk comprises a substantially circular line of weakness.

5. The plant as claimed in claim 3, wherein the rupture disk is covered by a removable protective plate.

6. The plant as claimed in claim 5, wherein the protective plate is bolted to the rupture disk.

7. The plant as claimed in claim 1, wherein each conduit is substantially tubular.

8. The plant as claimed in claim 1, wherein at least one of the conduits comprises a flange that surmounts the conduit.

9. The plant as claimed in claim 8, wherein the flange is blanked off by at least one rupture disk.

10. The plant as claimed in claim 8, wherein the flange is covered by at least one removable protective plate.

11. The plant as claimed in claim 1, wherein said uninterrupted parallelepiped volume comprises an open space without obstruction.

12. The plant as claimed in claim 1, wherein one or more of the four conduits are configured to receive and retain both a recovery line and said long tubular needle, where the recovery line extends to a salvage vessel, and wherein the long tubular needle extends into the tank and terminates proximate to the lower surface opposite from the respective conduit.

13. The plant as claimed in claim 12, wherein the long tubular needle comprises a valve accessible at the exterior of the marine vessel, the valve being configured to receive and retain an end of a recovery line.

14. The plant as claimed in claim 1, wherein the upper surface of the tank comprises a central region which extends generally between the four conduits.

15. The plant as claimed in claim 14, wherein the central region is a continuous, uninterrupted surface.

16. The plant as claimed in claim 14, wherein the central region is without a conduit.

* * * * *